United States Patent [19]

Vinciguerra et al.

[11] 4,388,752

[45] Jun. 21, 1983

[54] METHOD FOR THE SEALTIGHT JOINTING OF A FLANGED SLEEVE TO A PIPELINE, ESPECIALLY FOR REPAIRING SUBSEA PIPELINES LAID ON VERY DEEP SEA BOTTOMS

[75] Inventors: Costantino Vinciguerra, Florence; Giampaolo Bonfiglioli, Inzago, both of Italy

[73] Assignees: Nuovo Pignone S.p.A., Florence; Snam S.p.A., Milan, both of Italy

[21] Appl. No.: 259,380

[22] Filed: May 1, 1981

[30] Foreign Application Priority Data

May 6, 1980 [IT] Italy ..... 21811 A/80

[51] Int. Cl.[3] ..... B23P 17/00

[52] U.S. Cl. ..... 29/421 R; 29/446; 29/523; 29/402.08; 72/58; 138/147; 138/172; 285/382.5

[58] Field of Search ..... 29/421 R, 446, 523, 29/402.08; 72/58, 61; 285/382.4, 382.5; 138/147, 172

[56] References Cited

U.S. PATENT DOCUMENTS

| | | | |
|---|---|---|---|
| 2,337,247 | 12/1943 | Kepler | 29/446 X |
| 2,460,580 | 2/1949 | Huber | 29/421 R |
| 3,023,495 | 3/1962 | Noland | 29/446 X |
| 3,064,344 | 11/1962 | Arne | 29/421 R |
| 3,114,968 | 12/1963 | Rudelick | 72/58 X |
| 3,439,405 | 4/1969 | Berman et al. | 29/446 X |
| 4,066,619 | 2/1977 | Anderson | 72/58 X |
| 4,075,755 | 2/1978 | Bernatt et al. | 29/421 R X |
| 4,332,073 | 6/1982 | Yoshida et al. | 29/421 R |

FOREIGN PATENT DOCUMENTS

| | | | |
|---|---|---|---|
| 368111 | 3/1932 | United Kingdom | 29/421 R |

*Primary Examiner*—Charlie T. Moon

*Attorney, Agent, or Firm*—George P. Hoare, Jr.

[57] ABSTRACT

A method for connecting in a sealtight manner a flanged sleeve to a pipe, especially for subsea gas and oil ducts, comprises the steps of introducing the free end of the pipe into the flanged sleeve with a clearance, expanding the pipe within the sleeve with the aid of a resilient expansible body which is axially compressed, releasing the axial compression and withdrawing the expansible body. The radial expansion is such as to expand the pipe at its plastic deformation condition and the sleeve within its elastic deformation limit, so that a union is achieved between the tube and the sleeve which is virtually indissoluble.

6 Claims, 3 Drawing Figures

Figure 1:
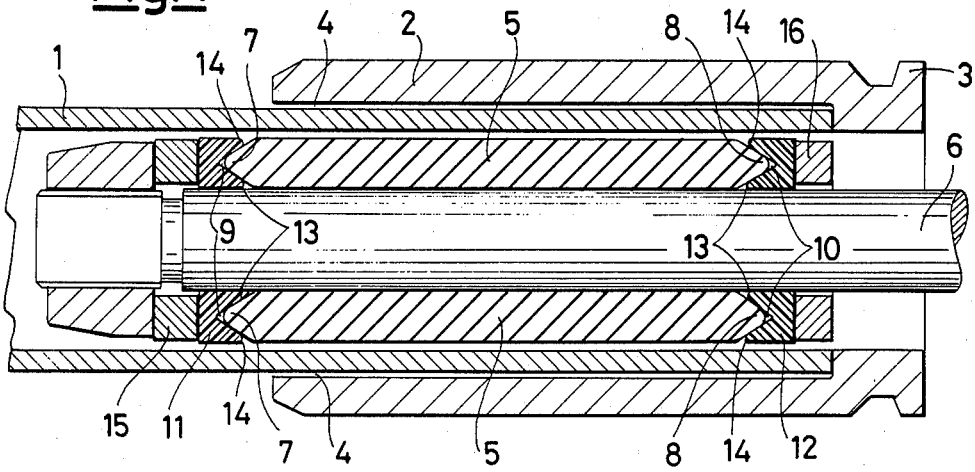

METHOD FOR THE SEALTIGHT JOINTING OF A FLANGED SLEEVE TO A PIPELINE, ESPECIALLY FOR REPAIRING SUBSEA PIPELINES LAID ON VERY DEEP SEA BOTTOMS

This invention relates to a novel method which, inasmuch as it permits that a sealtight coupling may be obtained quickly, cheaply and efficiently between a flanged sleeve and a pipeline, makes possible rapidly to repair damaged pipelines also when these have been laid at great sea depths.

As is known, the sequence of steps which is required for repairing a pipeline which has been damaged comprises the steps of cutting the damaged pipeline section and the sealtight jointing, to each of the so stripped ends of the undamaged sections of the pipeline, of an external flanged sleeve which is adapted to unite the two unaffected pipeline sections by means of a pipe shank sealtightly secured to both said flanged sleeves and therebetween.

The present state of the art has shown a number of methods for carrying out the sealtight jointing of a flanged sleeve to a tube without resorting to the time-consuming and expensive welding operation.

One of said conventional methods consists in carrying out the jointing by explosion, that is, to expand the tube and the sleeve plastically by explosive charges appropriately positioned in the tube interior. Such a method, however, in addition to its having a high degree of risk, is also unreliable due to the extreme difficulty of properly positioning the explosive charges within the tube. In addition, its application to sea depth deeper than 600 meters, which are those for which the present method will actually be carried out and for which it has specially been designed, would become very intricate and thus costly inasmuch as the water contained in the pipeline should be emptied, inter alia.

Another conventional method, instead, uses a flanged sleeve made with a material having a negative expansions coefficient, that is, a material which shrinks as the temperature is increased. By this second method, the sleeve aforesaid is brought to the temperature of liquefied nitrogen, that is about 196 degrees below 0° C. and is then slipped onto the pipe, whereafter the temperature is permitted to return to the ambient value whereby the sleeve, by shrinking, will press the tube and stick thereto in a sealtight manner.

The junctions so made are highly efficient both from the point of view of the pressure since the tight seal is extended the entire sleeve length throughout, and the axial stresses, because the strong adherence between the sleeve and the tube prevents any axial sliding motion: nonetheless, it is immediately apparent that such a procedure is not certainly a practical, quick and cheap means for providing a junction, especially when the latter must be provided at the considerable sea depths aforementioned.

On the other hand, the method just summarized above has also the defect of generating, in any case, a wider or a narrower shrinking or contraction of the tube, and this is detrimental in the pipes used as oil or gas pipelines since it might prevent the free running therein of the so-called "pigs", that is, carriages equipped for taking panoramic X-ray views of the welding seams and checking the mechanical properties of the pipings.

Then, according to another conventionally known method, use is made of a particular sleeve which is provided beforehand in its interior with sealing and skid-preventing members which are pressed onto the tube by the force of hydraulic pressure.

The latter method, though it can be applied rapidly and also conveniently enough also at great depths, has, however, the twofold shortcoming that is not cheap enough, due to the high cost of the sleeve, and that its sealtightness is poor inasmuch as the seal is not extended to the entire sleeve length but is restricted only to the spots where said sealing members are caused to be active.

An object of the present invention is to do away with the shortcomings aforementioned, thus providing a novel method whereby the sealtight junction of a flanged sleeve to a piping can be made efficiently, quickly and cheaply in a simple manner also at great sea depths and without causing any contractions or shrinkings of the pipe concerned.

This object is achieved in a substantial manner by applying the well known principle according to which it is possible to produce, between a pipe and a sleeve mounted thereon, a residual interference (negative allowance) which generates so intensive a pressure as to ensure an efficient seal along the entire sleeve length, together with a high resistance to axial thrusts and strains, and thus to the mutual sliding between the sleeve and the tube, by merely causing the tube-sleeve assembly to be properly expanded, whereafter the expansion force is anulled, with the provision that the sleeve is made of a material having a degree of elastic deformation which is greater than that of the tube.

As a matter of fact, this known principle has already been adopted to make junctions between tubes and sleeves, but its practical application has compulsorily been restricted to very limited fields, that is, to junctions of parts having a high ductility which thus required comparatively low expansive pressural forces.

Summing up, the application of such a principle has been precluded heretofore to the field of pipings for oil and gas pipelines and, more generally, to the field of the least ductility metals, such as high-tensile steels (H.T.S.) and titanium-based alloys, just on account of the physical impossibility of obtaining the high pressure values which were required for expanding radially, up to the limit of elastic deformation of the sleeve, a tube-and-sleeve assembly made of H.T.S. or titanium-based alloys.

It has now been detected by fieldtests that a plug of stiff rubber, having an annular cross-sectional outline and idly mounted on a H.T.S. shaft and enclosed between two anti-extrusion Nylon rings, also idly mounted on said shaft, the lateral circumferentially tapered ends of said plug being respectively inserted into a V-shaped circumferential groove of each of the confronting front faces of said rings, is capable of producing, whenever it is axially compressed within a tube, very high radial expansion pressures in the order of magnitude of 2,000 to 3,000 atmospheres.

As a matter of fact, any extrusion of the plug is totally prevented by said two Nylon rings, which, by being deformed, immediately and pressurally adhere to the shaft and to the inner wall of said tube as well.

By adopting such a procedure for generating the requisite radial expansion pressures, it is now possible, as a result, to apply the principle in question also to the field of pipings for oil and gas pipelines.

Therefore, the method according to the present invention for joining in a sealtight manner a cylindrical flanged sleeve having a constant cross-sectional area to a H.T.S. tube, said sleeve being mounted with a certain clearance onto the free end of the piping and being made with a metallic material having a degree of elastic deformation greater than that of the piping, is characterized in that it comprises, in the order given, the steps of inserting into the tube-and-sleeve assembly a plug of stiff rubber having an annular cross-sectional outline and idly mounted on a H.T.S. shaft and enclosed between two anti-extrusion Nylon rings also idly mounted on said shaft, the circumferentially tapered side ends of said plug being respectively inserted in a circumferential V-shaped groove of each of the confronting front faces of said rings, axially compressing said plug of stiff rubber and acting upon said Nylon rings for generating a radial expansion pressure, continuing said axial pressural action on said plug in order radially to expand the tube-sleeve assembly so as to bring said sleeve to its elastic deformation limit and finally releasing the pressure on said plug and withdrawing the same from the piping.

In summation, for joining in a sealtight manner a flanged sleeve to a steel piping it is only necessary, according to the invention, to place the sleeve onto the free end of the piping, that which is facilitated by providing a clearance between the sleeve and the piping and merely to act from the inside of the piping with said stiff rubber plug. As a matter of fact, the axial compression of the plug will originate, in the radial direction, an expanding force which, at the outset, will generate a radial expansion of the only portion of the piping which contacts the sleeve and this expansion will first be of an elastic nature and subsequently it will be a plastic deformation as soon as the yielding point of the material of the piping is exceeded. When, subsequently, the deformation of the piping attains a value equalling the clearance existing between the piping and the sleeve, the further plastic expansion of the piping which is made possible by the very high expansive pressure produced by the plug, will also induce an elastic expansion of the sleeve and this will be continued by insisting in the plastic expansion of the piping up to the limit of elastic deformation of the sleeve: the latter limit, as specified above, must be greater than that of the pipe. At this stage, by releasing the pressure on the plug, a springback will be experienced, both of the tube and the sleeve, but, while the pipe will be capable of totally recovering that portion of its deformation which has taken place elastically, because nothing opposes its shrinking, this will not be true, conversely, of the sleeve, which has undergone an elastic deformation more intensive than that of the piping. As a matter of fact, after that the sleeve has gone through a springback equal to that of the pipe and has thus recovered only a fraction of the elastic deformation it underwent, a further shrinking of the sleeve with a view to recovering the residual elastic deformation will be barred by the presence of the plastically deformed pipe.

Stated another way, between the sleeve and the plastically deformed pipe lying in its interior, a residual interference is originated, which prevents the sleeve from recovering its elastic deformation entirely and from being thus restored to its initial dimensions it had prior to being expanded radially. Such a residual elastic deformation of the sleeve, which cannot be recovered due to said residual interference between the sleeve and the pipe, and which would tend to shrink the sleeve until bringing it back to its initial dimensions, will thus produce the effect of pressing the sleeve against the inner tube wall and consequently of generating, between the sleeve and the tube, a pressure which, by being applied all the sleeve length throughout, will ensure an efficient seal between the tube and the sleeve concurrently with a very high resistance to axial sliding motions.

From the foregoing, it will thus be understood that the method according to this invention, by virtue of its extreme ease of application, can efficiently and cheaply be adopted also for pipelines laid at great sea depths.

On the other hand, as is well known, the degree of elastic deformation of any material is an intrinsic property of the material concerned and, more accurately, it is directly proportional to the yield point $\sigma_s$ of the material and is inversely proportional to the modulus of elasticity, E, of the material.

In order to fabricate the flanged sleeve of this invention, it is thus possible to count on two variables, viz. $\sigma_s$ and E: thus, as a result, and according to another feature of the present invention, the flanged sleeve is made with a H.T.S. having a yield point, $\sigma_s$, greater than that of the material of the piping, or, as an alternative, with a titanium-based alloy having a yield point $\sigma_s$ greater than that of the piping material and a modulus of elasticity, E, smaller than that of the piping material.

It is thus apparent that the junction which is obtained is the more efficient, the greater is the yield point $\sigma_s$ of the sleeve material with respect to that of the material of the tube, or the smaller is the modulus of elasticity, E, of the former relative to that of latter, because, the greater are these differences, the greater the degree of elastic deformation of the sleeve will be. Consequently, the degree of residual interference between the sleeve and the tube will be correspondingly exalted and the pressure originated by said residual interference enhanced. As a matter of fact, it should be borne in mind that the actual aim to be achieved is to generate, between the sleeve and the pipe, so high a pressure as to provide an efficient seal relative to the high pressures of the fluids flowing through the piping, and these can attain the magnitude of a few hundreds of atmosphere: a high resistance to axial sliding is also an objective to be achieved.

Consistently with the foregoing considerations, and according to a preferred embodiment of the present invention, the flanged sleeve is thus made with a H.T.S. having a yield point, $\sigma_s$, which is at least twice that of the pipe, or, as an alternative, with a titanium alloy having a yield point, $\sigma_s$, which is at least three times that of the pipe and a modulus of elasticity, E, equal to about one half of that of the pipe, so that the degree of elastic deformation of the flanged sleeve is at least twice that of the pipe.

It should also be borne in mind that the pressure generated by the residual interference between the sleeve and the pipe is not only a function of the magnitude of the residual interference aforesaid, but also, as is known in the art and also obvious, of the thickness of the sleeve.

Stated another way, the thickness of the sleeve is the third variable to count on in order to generate a certain pressure between the sleeve and the tubing, inasmuch as such a pressure can be increased by increasing said thickness.

On the other hand, it is also apparent that such a pressure cannot be increased indefinitely, but only up to a limiting magnitude which corresponds to the maximum pressure which can be withstood by the geometrical characteristics and the mechanical properties of the steel pipe, because a higher pressure imparted to the sleeve would crush the pipe and the results would be a loss of the hermetic seal.

Now, according to an additional feature of the present invention, the flanged sleeve is made with a thickness which is thicker than that of the pipe and is such that the pressure which is generated between the sleeve and the tube is close to the maximum pressure that the pipe can withstand.

The invention will now be shown and described with reference to the accompanying drawings which show a preferred practical embodiment illustrative of the best mode to reduce the invention into constructive practice, this illustration being a mere example without limitation since technical and constructional changes can always be introduced without departing from the scope of the invention.

Figure 2:
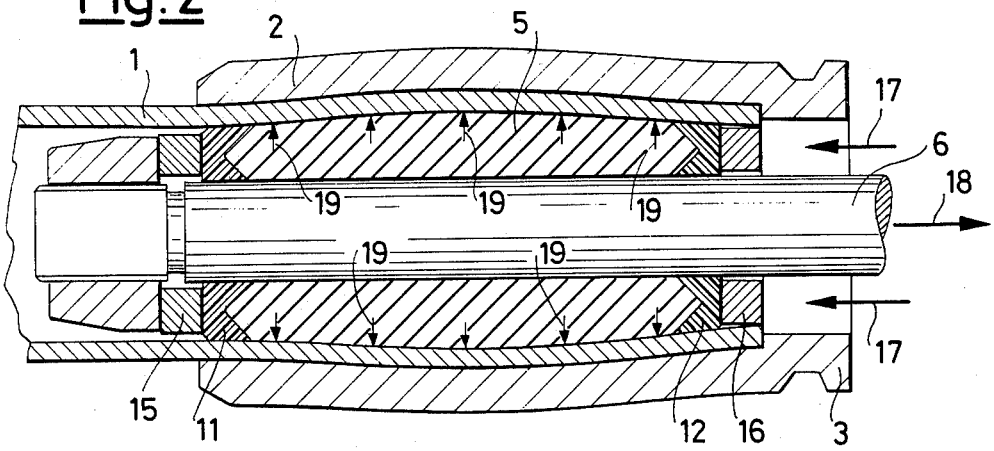
Figure 3:
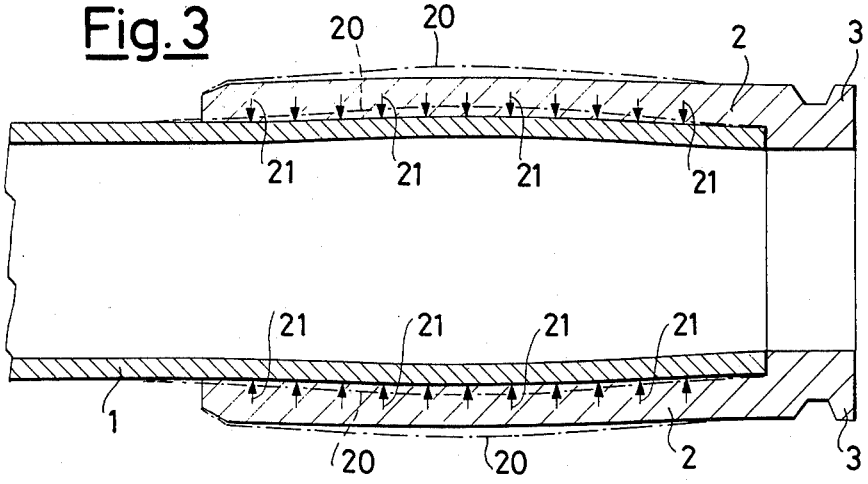

In the drawings:

FIGS. 1, 2 and 3 illustrate the different stages for conjoining in a sealtight manner a flanged sleeve with a pipe according to the method of the present invention, and, more particularly, FIG. 1 is a longitudinal cross-sectional view of a pipe end on which the flanged sleeve to be conjoined in a sealtight manner has been mounted with a certain clearance, the annular stiff rubber plug having been inserted thereto according to the invention.

FIG. 2 shows a longitudinal cross-sectional view akin to that of FIG. 1, but at the end of the stage of radial expansion of the tube-sleeve assembly as caused by the axial compression of the annular stiff rubber plug, according to the invention, and FIG. 3 is a longitudinal cross-sectional view of the final configuration as taken by the tube-sleeve assembly after its spring-back from its position of maximum radial expansion of FIG. 2, indicated in dash-and-dot lines, and after the withdrawal of the annular stiff rubber plug from said assembly.

Having now reference to FIG. 1, the reference numeral 1 indicates a H.T.S. pipe for oil or gas pipelines, the free end of which must be jointed in a seal-tight manner with a cylindrical sleeve, 2, having a constant cross-sectional area and which is fitted with a flange 3.

The sleeve 2 is made with a metallic material having a degree of elastic deformation greater than that of the pipe 1 and, more particularly, it is made with a metallic material of the same kind as that of the pipe, that is, with a H.T.S. which has, however, a yield point, $\sigma_s$, at least twice that of the pipe, or, as an alternative, with a metallic material of a kind different from that of the pipe, that is, with a titanium alloy having a modulus of elasticity, E, equal to about one half, and a yield point, $\sigma_s$, equal to about three times that of the piping. Moreover, the sleeve 2 is constructed with a wall thickness thicker than that of the pipe, the value of which is determined with well known mathematical formulae in such a way that the pressure generated by the residual interference between the sleeve and the pipe be close to the maximum pressure the tube can withstand without crushing.

Lastly, the inside diameter of the sleeve 2 is so selected that, once the sleeve has been slipped onto the free end of the pipe 1, it provides a certain clearance, 4, with the external surface of the pipe 1, that which facilitates the positioning of the sleeve even at very high depths of sea.

Into the assembly comprised of the tube 1 and the sleeve 2 is then introduced a stiff rubber plug 5 of annular cross-section, mounted idly on a shaft of H.T.S., 6. The plug has, in correspondence with each of its lateral ends a circumferential taper, 7 and 8, respectively, for introduction in circumferential V-shaped grooves, 9 and 10, respectively, as formed on the confronting front surfaces of two anti-extrusion Nylon rings, 11 and 12, also mounted idly on said shaft 6 and confining the plug 5 therebetween.

The stiff rubber plug 5 is axially compressed by acting upon said Nylon rings 11 and 12, that is, by causing the Nylon rings to approach one another. However, as the plug 5 becomes compressed, its circumferential tapers 7 and 8 transfer to the sloping walls of the V-grooves 9 and 10 of the Nylon rings 11 and 12 in which said tapers are inserted, an expansive pressure which brings the inner lips 13 and the outer lips 14 of said grooves 9 and 10 to adhere pressurally to the internal surface of the shaft 6, and to the internal surface of the pipe 1, respectively. Inasmuch as any possibility of extrusion is prevented, the rubber plug 5 can thus be compressed to very high values and, as field tests have shown, it is capable of producing radial expansion pressure in the order of magnitude of from 2,000 to 3,000 atmospheres.

It is apparent that the action upon the Nylon rings 11 and 12 intended to produce the axial compression of the plug 5, can be obtained with any appropriate means. In the FIGURES of the drawings, the use is shown of two additional shoulder rings 15 and 16 of H.T.S.. The ring 15, permanently secured to the shaft 6 has the Nylon ring 11 resting thereon, whereas the ring 16, mounted idly on the shaft 6, rests against the Nylon ring 12 and the axial compression of the plug 5 is produced by acting in opposite directions both on the idle ring 16 and the shaft 6 along the directions of the arrows, 17 and 18, respectively, of FIG. 2.

Thus, by axially compressing the stiff rubber plug 5, a radial expansion pressure (19, FIG. 2) is produced, which tends radially to expand both the pipe 1 and the flanged sleeve 2.

As the plug 5 is capable of producing the necessary pressure, the radial expansion is continued until bringing the sleeve 2 to its limit of elastic deformation which, as outlined above, is at least twice that of the pipe 1. Once this limit is reached, the assembly of the pipe 1 and the flanged sleeve 2 becomes deformed as shown in FIG. 2. However, as the stiff rubber plug 5 is withdrawn from the pipe 1 upon releasing the axial pressure, the assembly of the pipe 1 and the flanged sleeve 2 undergoes spring-back which brings it from the configuration shown in FIG. 2 and also depicted in dash-and-dot lines in FIG. 3 at 20, to the final configuration, shown in solid lines in FIG. 3. The residual interference which has been produced between the tube and the sleeve, due to the fact that the flanged sleeve 2 can recover only a fraction of the elastic deformation it underwent because of the presence of the plastically deformed pipe 1, thus generates between the pipe 1 and the flanged sleeve 2 a pressure, 21, which provides an effective seal all the length of the sleeve 2 throughout, together with a very high resistance to mutual sliding between the pipe and the sleeve.

We claim:

1. A method for jointing in a sealtight manner a high tensile steel pipe to a cylindrical flanged sleeve having a constant cross-sectional area, said sleeve being mounted with a certain clearance onto the free end of said pipe and being made with a metallic material having a degree of elastic deformation greater than that of the pipe, characterized in that it comprises the sequential steps of inserting in the pipe-sleeve assembly a stiff rubber plug of annular cross-section idly mounted on a high tensile steel shaft and confined between two anti-extrusion Nylon rings also idly mounted on said shaft, in a circumferential V-shaped groove of the confronting front surfaces of said rings the respective tapered lateral ends of said plug being inserted, axially compressing said stiff rubber plug, acting upon said Nylon rings to generate a radial expansion pressure, continuing said axial compression of said plug to expand the pipe-sleeve assembly radially until exceeding the yield point of the pipe to plastically expand same and bringing the sleeve to its limit of elastic deformation, and finally releasing the pressure of the plug to allow the elastically deformed sleeve to contract onto said plastically expanded pipe to produce an interference fit therebetween and withdrawing said plug from the pipe.

2. Method according to claim 1, characterized in that said flanged sleeve is composed by a high tensile steel having a yield point $\sigma_s$, greater than that of the pipe.

3. Method according to claim 1, characterized in that said flanged sleeve is composed by a titanium-based alloy having a yield point, $\sigma_s$, greater than, and a modulus of elasticity, E, smaller than, the respective values for the pipe.

4. Method according to claim 1, characterized in that said flanged sleeve is composed by a high tensile steel having a yield point, $\sigma_s$, at least twice that of the pipe.

5. Method according to claim 1, characterized in that said flanged sleeve is composed by a titanium-based alloy having a yield point, $\sigma_s$, about thrice that of the pipe and a modulus of elasticity, E, equal to one half that of the pipe.

6. Method according to any of the preceding claims, characterized in that said flanged sleeve is constructed with a wall thickness thicker than that of the pipe and such that the pressure which is generated between the sleeve and the pipe is close to the maximum pressure the pipe can withstand.

* * * * *